US010031482B2

(12) United States Patent
Behra

(10) Patent No.: US 10,031,482 B2
(45) Date of Patent: Jul. 24, 2018

(54) TUNE SELECTION MECHANISM FOR A CHIMING TIMEPIECE

(71) Applicant: Blancpain SA, Le Brassus (CH)

(72) Inventor: Julien Behra, Les Rousses (FR)

(73) Assignee: Blancpain SA, Le Brassus (CH)

( * ) Notice: Subject to any disclaimer, the term of this patent is extended or adjusted under 35 U.S.C. 154(b) by 0 days.

(21) Appl. No.: 15/228,508

(22) Filed: Aug. 4, 2016

(65) Prior Publication Data

US 2017/0060095 A1 Mar. 2, 2017

(30) Foreign Application Priority Data

Aug. 31, 2015 (EP) ..... 15183110

(51) Int. Cl.

| | |
|---|---|
| ***G04B 21/06*** | (2006.01) |
| ***G04B 23/00*** | (2006.01) |
| ***G04B 21/10*** | (2006.01) |
| ***G04B 21/12*** | (2006.01) |

(52) U.S. Cl.

CPC ..... *G04B 23/005* (2013.01); *G04B 21/06* (2013.01); *G04B 21/10* (2013.01); *G04B 21/12* (2013.01)

(58) Field of Classification Search

CPC ..... G04B 23/005; G04B 21/06; G04B 21/00; G04B 21/12; G04B 21/10

See application file for complete search history.

(56) References Cited

U.S. PATENT DOCUMENTS 8,570,841 B2 * 10/2013 Goeller ..... G04B 11/024 368/244
8,625,395 B2 * 1/2014 Goeller ..... G04B 19/23 368/267
8,873,347 B2 * 10/2014 Goeller ..... G04B 21/00 368/261
9,557,715 B2 * 1/2017 Goldmann ..... G04B 21/06
2012/0230163 A1 9/2012 Goeller et al.

FOREIGN PATENT DOCUMENTS

| | | |
|---|---|---|
| CH | 689 337 A5 | 2/1999 |
| CH | 701 200 B1 | 12/2010 |
| CH | 704 590 A2 | 9/2012 |
| EP | 1 770 453 A1 | 4/2007 |
| EP | 1 770 453 B1 | 4/2007 |
| EP | 2 498 145 A1 | 9/2012 |

OTHER PUBLICATIONS

European Search Report dated May 24, 2016 in European application 15183110.4, filed on Aug. 31, 2015 (with English Translation of Categories of Cited Documents).

* cited by examiner

*Primary Examiner* — Sean Kayes
(74) *Attorney, Agent, or Firm* — Oblon, McClelland, Maier & Neustadt, L.L.P.

(57) ABSTRACT

Chiming timepiece comprising a movement and an acoustic indication mechanism with a control mechanism controlling the performance of a chime or tune by setting control lifts in motion that each actuate a hammer arranged to strike a gong, and each control lift is releasable between a released position, in which it is decoupled from the control mechanism, and a resting position, in which it is able to be driven for actuation of the hammer by the control mechanism that is set in motion by the movement, or by a manual actuator, and tune selection devices for the selection of at least one particular chime or tune are controlled by this movement or by a manual selector and control the passage of each control lift from its released position to its resting position or vice versa.

25 Claims, 4 Drawing Sheets

TUNE SELECTION MECHANISM FOR A CHIMING TIMEPIECE

This application claims priority from European Patent Application No. 15183110.4 filed on Aug. 31, 2015, the entire disclosure of which is hereby incorporated herein by reference.

FIELD OF THE INVENTION

The invention relates to an acoustic indication mechanism for a chiming timepiece comprising a timepiece movement and a manual control operable by a user and comprising at least one acoustic indication mechanism with a control mechanism arranged to control the performance of a chime or tune by setting in motion at least one control lift to actuate at least one hammer arranged to strike a gong, where at least one so-called control lift is movable between at least one released position, in which it is decoupled from said control mechanism, and a resting position, in which it is able to be driven for actuation of said hammer by said control mechanism that is set in motion, or also by said timepiece movement, or by an actuator forming part of said manual control, and where said timepiece also comprises tune selection devices for the selection of at least one particular chime or tune, which are controlled either by said timepiece movement or by a selector forming part of said manual control, and where said tune selection devices are arranged to control the passage of said at least one control lift from its released position to its resting position or vice versa, where said acoustic indication mechanism comprises a plurality of control levels parallel to one an other and parallel to lift planes, in which said control lifts are arranged, and in each of these control levels said control mechanism comprises a control part, which, when said control part is set in motion by said timepiece movement or said actuator, is arranged to drive at least one said control lift positioned in said resting position and located in a lift plane coplanar with said control level of said control part.

The invention also relates to a timepiece or watch comprising at least one such acoustic indication mechanism.

The invention also relates to a musical box comprising at least one such acoustic indication mechanism.

The invention concerns the field of timepieces comprising an acoustic indication as well as the related field of musical boxes or similar.

BACKGROUND OF THE INVENTION

Repeater striking mechanisms are exceptional pieces because of their large number of components and the care and time taken in production and assembly. Striking complications have been known since at least the 18th century, but have only been the subject of a limited number of publications between 1763 and the middle of the 20th century. The reference work well known to the skilled craftsman in complications, in particular large striking and repeater mechanisms, which will be referred to so as not to overload the explanation of the invention, is the treatise "Les montres compliquées" [Complicated watches] written by François Lecoultre and published by Editions horlogères à Bienne. It is completed by the collective work "Théorie d'horlogerie" [Clockmaking Theory] by Messrs. Reymondin, Monnier, Jeanneret, Pelaratti, published by the FET (Fédération des écoles techniques) in Switzerland.

Chiming watches were invented to overcome the lack of night illumination in the past and to know the time at any moment.

Improvements have enabled the performance of tunes, e.g. by juxtaposing sequences in a predetermined order controlled by perforated discs or cylinders or pins such as those used in musical boxes.

However, chiming watches do not yet give all the possibilities provided by visual display watches and in particular the distinction of day/night, morning or afternoon (AM/PM) the distinction between several time zones (GMT) or also the breakdown of time according to particular scales, and as the user chooses.

Document EP 2 498 145 A1 in the name of MONTRES BREGUET S A describes a striking mechanism with differentiated chimes with a repeater striking assembly stage comprising a drive plate with pivoting pipe carrying a click with a beak restored by a spring and movable under the action of a pin of a detent ratchet cooperating with a striking control mechanism, wherein this stage comprises a pipe ratchet pivoting on this pipe to cooperate at the level of a toothing forming part thereof with the beak of the click, which permits or prevents the pivoting movement of the pipe ratchet, which is fixed to a first hour ratchet that cooperates with a first hammer drive lift. This stage comprises a second hour ratchet that pivots around the same axis and cooperates with a hammer drive lift of said striking mechanism.

Document EP 1 770 453 A1 in the name of CHRISTOPHE CLARET S A describes a mechanical timepiece comprising a time display mechanism for a first and a second time zone fitted with a striking device, which allows a chime corresponding to the time of the first or the second time zone to be produced by choice. This striking device is supplied with energy by a single striking barrel controlled by control elements intended to activate a chime corresponding to the time of the first and the second time zone.

SUMMARY OF THE INVENTION

The invention proposes to render a timepiece with acoustic indication, in particular a watch, more versatile by giving the user the possibility of distinguishing between particular circumstances of use, depending on the tune played and/or gongs used. These improvements also relate to musical boxes.

For this, the invention relates to an acoustic indication mechanism for a chiming timepiece according to claim 1.

The invention also relates to a timepiece or watch comprising at least one such acoustic indication mechanism.

The invention also relates to a musical box comprising at least one such acoustic indication mechanism.

BRIEF DESCRIPTION OF THE DRAWINGS

Other features and advantages of the invention will become clear from reading the following detailed description with reference to the attached drawings.

DETAILED DESCRIPTION OF PREFERRED EMBODIMENTS

Figure 1:
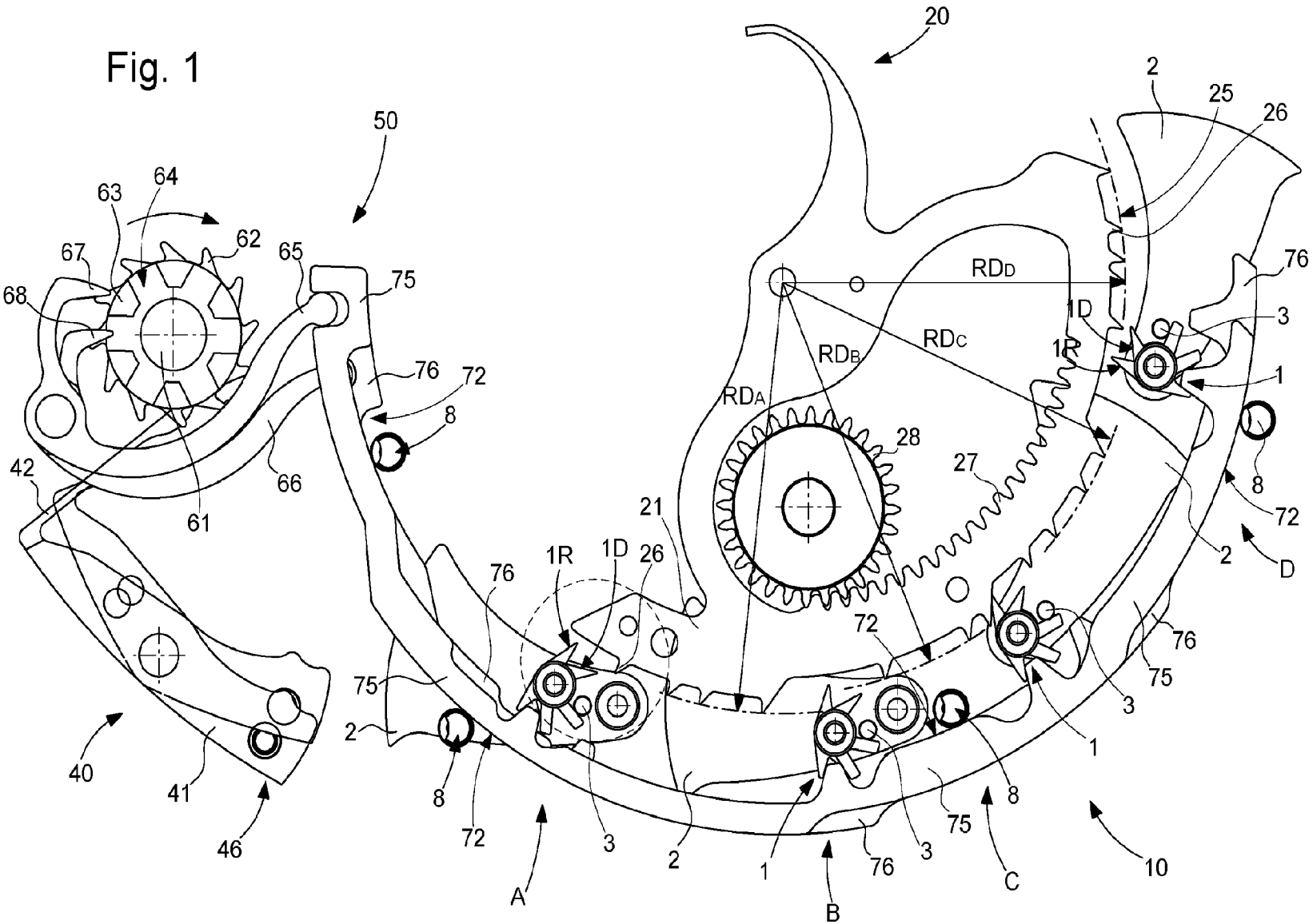
FIG. 1 is a schematic plan view of an acoustic indication mechanism according to the invention comprising a part of a striking mechanism with an acoustic indication mechanism and a control mechanism arranged to control the performance of at least one chime or tune by setting control lifts in motion to actuate hammers arranged to strike gongs that are not shown in the figure. The control mechanism is shown in part: a drive wheel movable by a timepiece movement or by a bolt (that are not shown), drives a control part, which is a quarter hour part here, the toothing of which cooperates or not with releasable lifts specific to the invention, wherein these releasable lifts can change angular position under the action of arc-shaped operating rods pulled or pushed by a column wheel, depending on the position selected by a user for a control lever. The figure shows two such rods superposed, the upper rod holding the upper lifts in a released position, while the lower rod causes the lifts to be brought into a resting position, to which they are pulled by springs (not illustrated) and where a beak forming part of each of these lifts can interfere with the toothing of the quarter hour part during rotation thereof to play a chime or a tune.

The invention proposes to configure a selection mechanism for a chime or tune for a timepiece, in particular and non-restrictively a watch or a musical box, which can be easily controlled by the user and/or by a timepiece movement. The term "chiming mechanism" will be used hereafter to equally denote a chiming mechanism or a mechanism for performing a tune.

In the particular case of a watch, the invention endeavours to occupy the minimum space possible, in particular by freeing the centre of the timepiece and transferring the selection mechanisms as far as possible to the periphery of the case. This space saving is also intended to permit the timepiece to be equipped with more control parts such as quarter hour parts or similar than in the prior art and also allows the use of a higher number of hammers and chimes. The invention is based on an architecture of guidance, selection, control, operation and percussion on different levels parallel to one another. The invention is described in the preferred and non-restrictive case where these parallel levels are all plane.

The invention relates to musical or chiming mechanisms and more particularly chime and/or tune selection mechanisms. Patent applications EP 14169217.8 and CH 0769/14 of the same applicant are incorporated herein by reference. These applications describe a mechanism for selecting a chime or tune by action on control parts, in particular quarter hour parts.

The invention proposes selection by action on hammer control lifts by making these stops releasable and movable under the action of selection devices.

Thus, the invention relates to a chiming timepiece 100 comprising a timepiece movement 30 and a manual control 40 operable by a user. This timepiece 100 comprises at least one acoustic indication mechanism 10 with a control mechanism 20 arranged to control the performance of at least one chime or tune by setting in motion at least one control lift 1 to actuate at least one hammer 2 arranged to strike a gong.

The acoustic indication mechanism 10 can be a grande sonnerie or petite sonnerie or minute repeater or carillon or alarm mechanism, or even a musical box or similar. The invention is described here in the case of a timepiece, but a person skilled in the art will be able to adapt the instructions to a musical box or other similar type of mechanism. The present description does not explain in detail standard chiming control mechanisms well known to a person skilled in the art specialising in chiming mechanisms.

According to the invention at least one such control lift 1 is movable between at least one released position where it is decoupled from the control mechanism 20 and a resting position where it is able to be driven for actuation of the hammer 2 by the control mechanism 20, which is set in motion either by the timepiece movement 30 or by an actuator 45 forming part of the manual control 40. This actuator 45 can classically be a bolt or similar.

The timepiece 100 also comprises tune selection devices 50 for selecting at least one particular chime or tune, which are controlled either by the timepiece movement 30 or by a selector 46 forming part of the manual control 40 such as a push piece or similar.

These tune selection devices 50 are arranged to control the passage of at least one such control lift 1 from its released position to its resting position and vice versa.

In an advantageous configuration the acoustic indication mechanism 10 comprises a plurality of control levels parallel to one another and parallel to lift planes, in which such control lifts 1 are arranged. In each of these control levels the control mechanism 20 comprises a control part 21, which, when the control part 21 is set in motion by the timepiece movement 30 or by the actuator 45, is arranged to drive at least one such control lift 1 initially positioned in its said resting position and located in a lift plane coplanar with the control level of the control part 21. A control level can cooperate with either a single lift plane or with several different lift planes.

For clarity of the figures the invention is illustrated with a single control part 21, which is a quarter hour piece, here driven by its inside toothing 27 by a wheel 28 connected to the striking barrel. The same wheel 28 can drive several inside toothing arrangements 27 of superposed control parts along parallel planes. This quarter hour piece 21 classically comes into abutment with its beak against a snail (not shown in the figures), and it comprises a toothing 25 comprising teeth 26 to cause the control lifts 1 located on its passage to pivot. FIG. 1 shows that this quarter hour piece 21 comprises four toothed sectors with decreasing radii RDA, RDB, RDC, RDD, which are arranged to cooperate respectively with control lifts 1 located on likewise decreasing radii RA, RB, RC, RD visible in FIG. 2. Thus, no interference can occur either between the quarter hour chiming mechanisms or on the passage to the minute chiming mechanisms in the case of a classic minute repeater mechanism.

Figure 2:
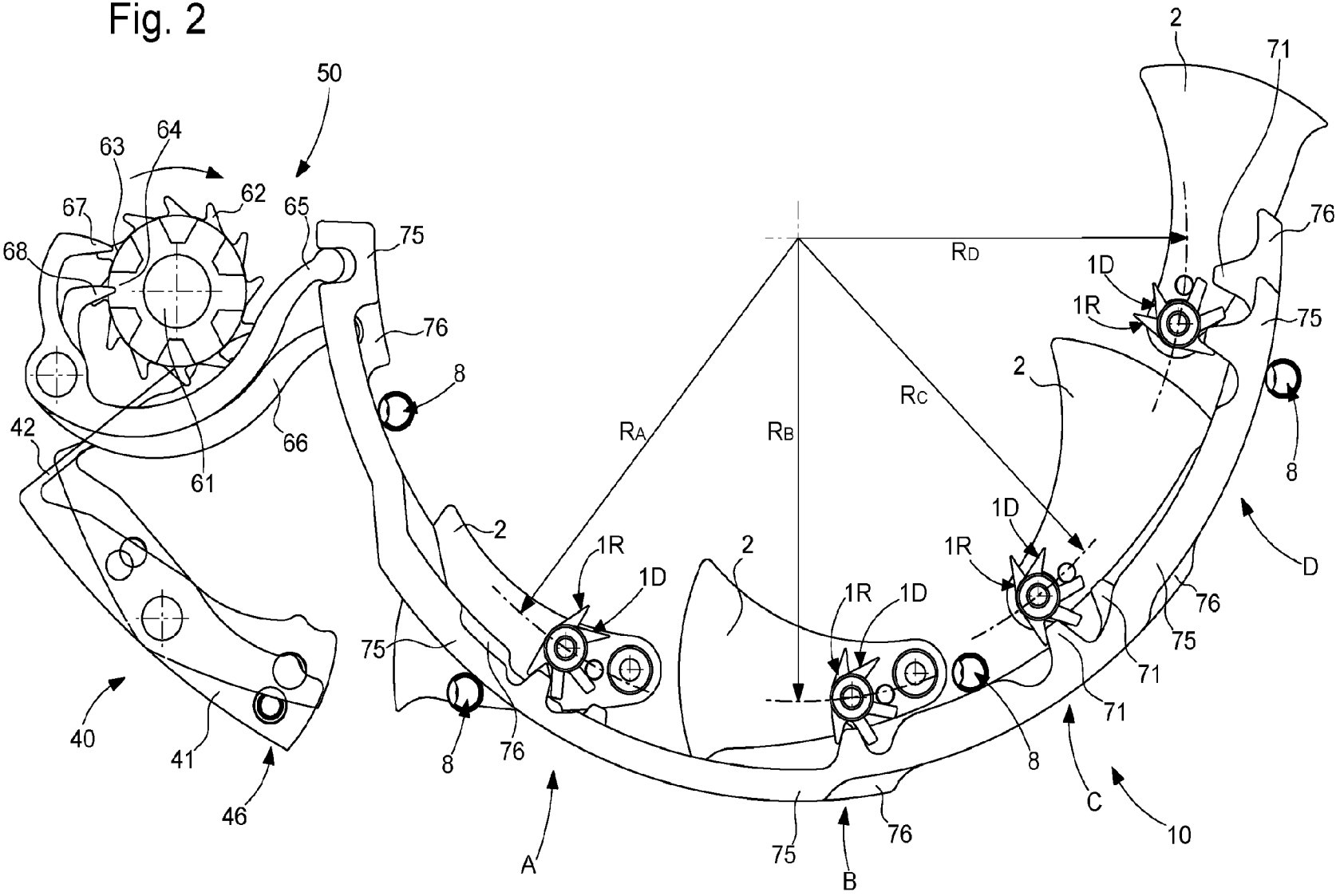
FIG. 2 shows the mechanism of FIG. 1 in the same position with the quarter hour part removed.

More particularly, at least one such control part 21 of such a control level is arranged to drive a plurality of such control lifts 1 all located in the same lift plane coplanar with the control level of the control part 21. This is the case with the configuration illustrated in the figures. FIG. 2 shows an upper lift plane comprising control lifts 1 all positioned in a released position referenced 1D and a lower lift plane that comprises control lifts 1 referenced 1R all positioned in a resting position, in which they can cooperate with either a control part 21 common to the upper and lower lift planes or with a lower control part 21 parallel to that controlling the upper lift plane.

In a variant, at least one such control part 21 of such a control level is arranged to drive a plurality of control lifts 1 located in at least two different lift planes.

Advantageously, the tune selection devices 50 are arranged to simultaneously control in a given lift plane the passage of each control lift 1 controlled by the control part 21 located at a control level controlling the given lift plane from one to the other of its said released or resting positions.

In a particular configuration, and as evident from the example illustrated by the figures, the tune selection devices 50 are arranged to simultaneously control in a given lift plane the passage of each control lift 1 forming part of the lift plane from its said released position to its said resting position or vice versa such that at any instant when they are in a free state without interaction with the control part 21 located at a control level controlling this given lift plane, all the control lifts 1 forming part of the given lift plane are either in their released position or in their resting position. Thus, either a silent mode or activation of a chiming sequence or tune occurs.

In a particular configuration, and as evident from the example illustrated by the figures, the tune selection devices 50 are arranged to simultaneously control two control lifts 1 that are located in different lift planes and together form a pair, so that one of these control lifts 1 of the pair is in its resting position when the other of these control lifts 1 of the pair is in its said released position, as evident in FIG. 2 where these lifts are referenced 1R and 1D in the lower lift plane and in the upper lift plane respectively. Thus, when the two lifts 1D and 1R of the same pair are arranged to come to rest on the same stop 3 of the same hammer 2, it is ensured that this stop 3 is pushed by a single control lift 1 at a time.

In an advantageous variant in the case where the same control level corresponds to a single control part 21, on at least this control level all the control lifts 1, with which this control part 21 cooperates, are distributed over at least two different lift planes, an upper lift plane and a lower lift plane in the illustrated configuration here, and two by two form such pairs so that one of the control lifts 1 of each pair is in its resting position when the other of the control lifts 2 of the same pair in its released position.

Naturally, any other arrangement is achievable, in particular for carillon-type applications, by combining and/or superposing different sequences of basic tunes.

In the non-restrictive configuration illustrated in the figures, the tune selection devices 50 comprise at least one operating rod 7, which is movable in a selection stage where the operating rod 7 is arranged to cooperate with all the control lifts 1 forming part of such a given lift plane.

In a variant that is not illustrated the tune selection devices 50 comprise at least one operating rod 7, which is movable in a selection state where the operating rod 7 is arranged to cooperate with all such control lifts 1 forming part of at least two adjacent lift planes, wherein these control lifts then all belong to different pairs and can also cooperate with different control stages.

The tune selection devices 50 preferably comprise a plurality of such operating rods 7 that are each movable in such a selection stage and parallel to the others. FIGS. 1 and 2 thus show an upper rod 75, which holds control lifts 1 in released position 1D in an upper lift plane over the four lift positions A, B, C, D, and a lower rod 76, which holds control lifts 1 in resting position IR in a lower lift plane over the four lift positions A, B, C, D.

Figure 5:
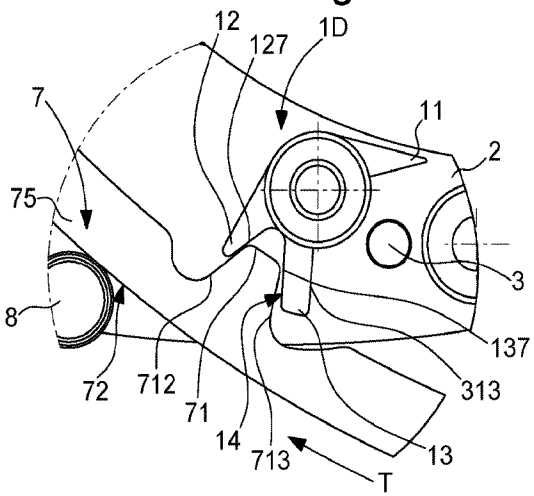
FIG. 5 shows the pendant in pulled position of the operating rod with lift held in released position by a raised section of the rod corresponding to the upper lifts of FIG. 1.

Preferably and as illustrated in FIGS. 1 and 2, each such operating rod 7, 75, 76 comprises raised areas 71, with the same curvilinear spacing as the control lifts 1, which this operating rod is arranged to cooperate with, said raised areas being arranged to each cooperate with the peripheral contour 14 of a corresponding control lift 1 to cause this control lift 1 to change position during the relative movement of the operating rod in relation to the control lift 1 concerned by pivoting and/or translation movement of the control lift 1 and to immobilise this corresponding control lift 1 when it is in its said released position, as evident in FIG. 5.

In a non-restrictive configuration corresponding to FIGS. 1 and 2, the operating rod 7 comprises concentric circular profiles 72 for guidance on runners 8 forming part of a bottom plate or a bridge of the timepiece 100.

The control lifts 1 are preferably guided in relation to guide elements (not shown) attached to such a bottom plate or such a bridge. If in the variant of the figures the control lifts 1 are mounted to pivot, they can also adopt other kinematics, in particular by translation movement in a groove or similar.

In another configuration that is not illustrated the operating rod 7 comprises straight parallel profiles for guidance on such runners 8 or on other similar guide elements.

In a particular variant, in a given lift plane, several control lifts 1 are arranged to actuate hammers 2 located on different hammer planes, at the level of which these hammers 2 are arranged to strike different gongs.

In a particular variant, in a given lift plane, the tune selection devices 50 are arranged to simultaneously control the passage of each control lift 1 forming part of this given lift plane, from its released position to its resting position or vice versa. At each instant when they are in free state without interaction with the control part 21 controlling this given lift plane, some of these control lifts 1 forming part of this given lift plane are in their released position and the other control lifts 1 forming part of the same given plane are in their resting position. FIGS. 1 and 2 show the particular case where all the control lifts 1 of a given lift plane are either in released position or resting position.

In an advantageous variant each control lift 1 is fitted with elastic restoring elements endeavouring to bring it back to either its released or its resting position.

In the particular variant illustrated by the figures each control lift 1 is fitted with elastic restoring elements endeavouring to bring it back to its resting position.

In the particular variant illustrated by the figures each control lift 1 comprises a beak 11 arranged to cooperate with a toothing 25 of a control part 21 to drive this control lift 1 during a movement of the control part 21 to rest on the beak 11.

In a particular variant illustrated by the figures, on its periphery 14 and spaced from the beak 11, each control lift 1 comprises at least one hollow profile delimited by a first wing 12 and by a second wing 13. This hollow profile is arranged to cooperate with a raised section 71 forming part of an operating rod 7, 75, 76 belonging to the tune selection devices 50, and this operating rod 7 is arranged to control a change in position of each such control lift 1.

Figure 4:
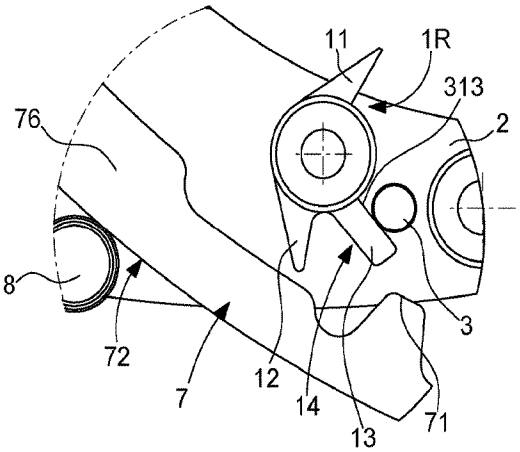
FIG. 4 is a schematic plan view of the action of an operating rod on the corresponding lift, shown here in pushed position where the lift interferes with the toothing of the quarter hour part and where one of its arms rests on a hammer stop ready to cause this to pivot on arrival of a tooth of the quarter hour part, and corresponding to the lower lifts of FIG. 1.

FIG. 4 shows the lower operating rod 76 in pushed position with a lower control lift 1 in resting position 1R where a stop face 313 of a second wing 13 forming part of it rests in abutment against the stop 3 of the corresponding hammer 2.

FIG. 5 shows the upper operating rod 75 is pulled position with a lower control lift 1 in released position 1D where a first wing 12 and a second wing 13 forming part of this control lift 1 together form a female dihedron cooperating by gripping with side faces 712 and 713, which together form a male dihedron, of the corresponding raised section 71 of the upper rod 75.

It is understood from these two figures that when one of the operating rods passes from its pushed position to its pulled position, the raised section 71 pushes the first wing 12 to cause the corresponding control lift 1 to pivot and cause this to pass from its resting position to its released position. The reverse move releases the control lift 1, which is restored by its return spring to its resting position where the second wing 13 comes into standby rest position for resting on the stop 3 of the hammer 2.

Figure 3:
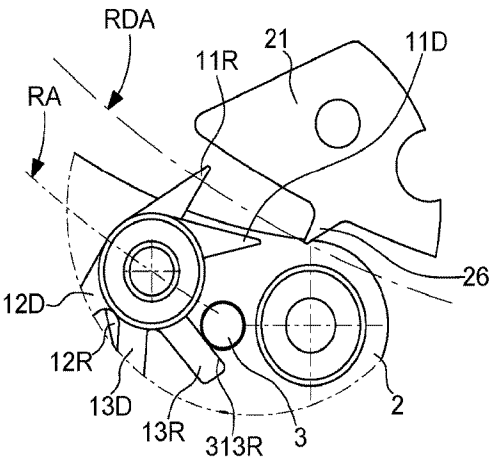
FIG. 3 is a schematic partial plan view of a detail encircled in FIG. 1 showing two superposed lifts, the upper in released position and the lower in resting position, where its beak is in the grip of the displacement of the toothing of the quarter hour part.

FIG. 3 shows the detail view of these two control lifts 1 superposed one on top of the other forming a pair, the upper one in released position 1D and the lower one in resting position 1R where its beak 11R is in the grip of the radius RDA of the corresponding teeth 26 of the control part 21.

Each hammer 2 comprises at least one hammer stop 3 arranged to be shifted by at least one such control lift 1. In the variant illustrated by the figures this stop 3 is a single one in a given lift plane.

When the hammer 2 bears several stops 3, they can be distributed on either side (above and below) the striking mass forming the hammer 2.

In another variant that is not illustrated at least one such hammer 2 comprises several such hammer stops 3, which are arranged to be shifted by different control lifts 1.

It is also possible to have several stops 3 on the same side of this striking mass that are arranged to cooperate with control lifts 1, which are not coaxial to one another.

In a further variant at least one such hammer 2 comprises at least one such hammer stop 3 arranged to be shifted by such different control lifts 1 located in different lift planes.

In the non-restrictive variant illustrated by the figures the manual control 40 actuates the tune selection devices 50 by means of guide devices 60, which comprise at least as many guide stages as the tune selection devices 50 have selection stages. Each such selection stage then comprises an operating rod 7 arranged to modify the position of at least one such control lift 1.

In the non-restrictive configuration of FIGS. 1 and 2 the manual control 40 comprises a selector 46 arranged to drive a control lever 41 controlling the movement of a hook 42 to pull a ratchet toothing 62 of a multi-stage column wheel 61 forming part of the guide devices 60.

On its periphery on each guide stage this multi-stage column wheel 61 comprises an alternation of solid 63 and hollow 64 profiles, towards which an upper 67 or lower 68 finger of an upper 65 or lower 66 selection lever is respectively restored by elastic restoring devices, which respectively drives by means of an articulated joint or similar at least one such upper 75 or lower 76 operating rod from the corresponding selection stage to the guide stage concerned.

Preferably and as evident in the illustrated configuration, the tune selection devices 50 comprise at least two selection stages, each comprising an operating rod 7, 75, 76 arranged to modify the position of at least one such control lift 1, wherein the operating rod 7, 75, 76 comprises a particular cam profile for performing, in combination with the control part 21 controlling the control lifts 1 of such a control level cooperating with the operating rod 7, 75, 76, at least one particular tune sequence, when at least one such control lift 1 is in resting position, or to remain in a silent mode if all the control lifts 1 of the control level concerned are each in released position.

In a particular configuration at least one lift is equipped with at least one spring endeavouring to bring it back into its resting position. This spring can be an elastic blade, in particular in a single piece with the lift. More particularly, all the lifts are equipped with such springs.

Figure 8:
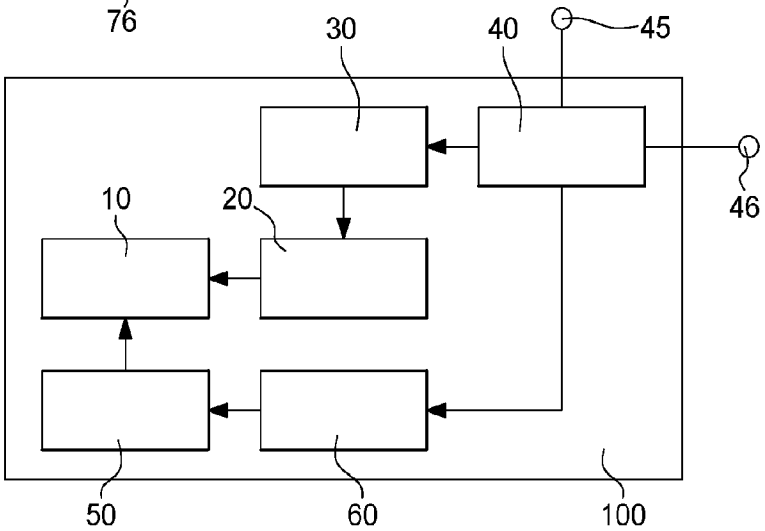
FIG. 8 is a block diagram of a timepiece according to the invention which can equally be a watch or a musical box.

In a particular configuration of FIG. 8 the timepiece 100 is a musical box.

Figure 7:
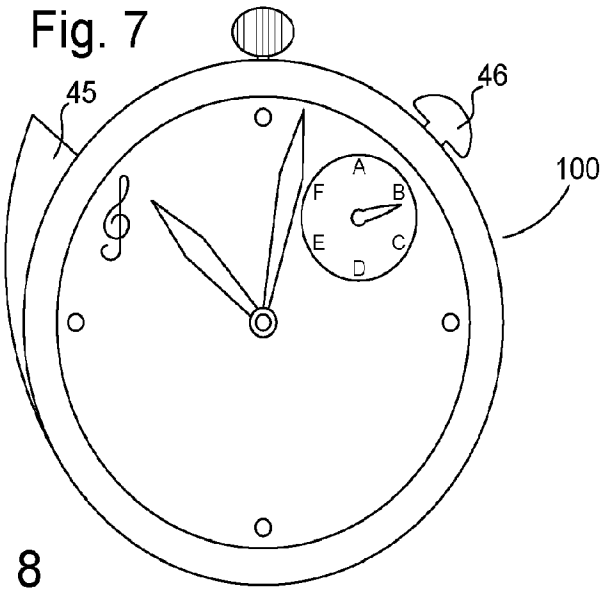
FIG. 7 shows a chiming watch fitted with a mechanism according to the invention comprising a selector actuating a tune selection device, an aperture enabling an identification mark for the selected tune to be displayed and comprising an actuator formed by a bolt for triggering a minute repeat chime.
Figure 6:
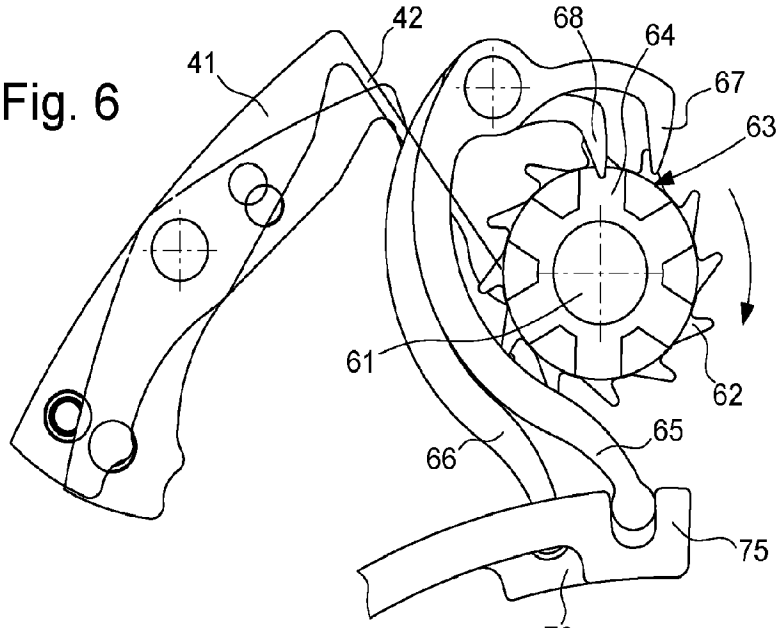
FIG. 6 is a detail of the control of the operating rods by a column wheel.

In a particular configuration of FIGS. 7 and 8 the timepiece 100 is a watch.

The invention allows a tune selection, but also a single gong selection.

The invention thus enables the user to select a tune or a gong for performing a particular chime. A similar selection is also possible by the movement 30 of the timepiece 100 directly. For example, the movement can control a first chiming tune for morning hours (AM) and another chiming tune for evening hours (PM), or also differentiate the chimes over two consecutive days, or even activate the playing of a first chime for a first time zone before activating another chime for a second time zone. The applications have no limit and such an acoustic indication with particular combinations of chimes and/or gongs can be more meaningful for the user than visual displays that are sometimes difficult to read on astronomical or time zone watches or similar.

The configured mechanisms are compact.

The invention only comprises components that work in traction mode and none in buckling mode.

The invention also lends itself to modifying existing acoustic indication mechanisms that are easily transformable with different geometries, in particular the operating rods can be adapted to the space available in the timepiece and their kinematics can be in rotation or in translation without changing the control functionality of the lifts.

What is claimed is:

1. A chiming timepiece comprising:

a timepiece movement and a manual control operable by a user and comprising at least one acoustic indication mechanism with a control mechanism arranged to control performance of at least one chime or tune by setting in motion at least one control lift to actuate at least one hammer arranged to strike a gong, where at least one of said at least one control lift is movable between at least one released position, in which the control lift is decoupled from said control mechanism, and a resting position, in which the control lift is able to be driven for the actuation of said hammer by said control mechanism that is set in motion, or also by said timepiece movement, or also by an actuator forming part of said manual control, and where said timepiece also comprises tune selection devices for selection of at least one particular chime or tune, which are controlled either by said timepiece movement or by a selector forming part of said manual control, and where said tune selection devices are arranged to control passage of said at least one control lift from a released position to the resting position or vice versa of the at least one control lift, where said acoustic indication mechanism comprises a plurality of control levels parallel to one another and parallel to lift planes, in which said control lifts are arranged, and in each of these control levels, said control mechanism comprises a control part, which, when said control part is set in motion by said timepiece movement or said actuator, is arranged to drive at least one said control lift positioned in said resting position of the at least one control lift and located in a lift plane coplanar with a control level of said control part, wherein said tune selection devices are arranged to simultaneously control in a given lift plane, the passage of each control lift controlled by said control part located at said control level, the control level controlling said given lift plane from one to the other of said released or resting positions of the control lift, and wherein said tune selection devices are arranged to simultaneously control in said given lift plane the passage of each control lift forming part of said lift plane from said released position to said resting position or vice versa of the control lift forming part such that at any instant when the tune selection devices are in a free state without interaction with said control part located at a control level controlling said given lift plane, all said control lifts forming part of said given lift plane are either in the released position or in the resting position.

2. The timepiece according to claim 1, wherein at least one control part of said control level is arranged to drive a plurality of said control lifts all located in the same lift plane coplanar with said control level of said control part.

3. The timepiece according to claim 1, wherein at least one said control part of said control level is arranged to drive a plurality of said control lifts located in at least two different lift planes.

4. The timepiece according to claim 1, wherein said tune selection devices are arranged to simultaneously control two said control lifts located in different lift planes and together form a pair so that one of said control lifts of said pair is in said resting position when the other of said control lifts of said pair is in said released position.

5. The timepiece according to claim 4, wherein on at least one said control level all said control lifts, with which said control part cooperates, are arranged in different lift planes, and two by two form said pairs so that one of said control lifts of each pair is in the resting position when the other of said control lifts of the same pair in the released position.

6. The timepiece according to claim 1, wherein said tune selection devices comprise at least one operating rod, which is movable in a selection stage where said at least one operating rod is arranged to cooperate with all said control lifts forming part of said given lift plane.

7. The timepiece according to claim 6, wherein said tune selection devices comprise said at least one operating rod, which is movable in a selection state where said at least one operating rod is arranged to cooperate with said control lifts forming part of at least two adjacent lift planes.

8. The timepiece according to claim 6, wherein said tune selection devices comprise a plurality of said operating rods that are each movable in said selection stage and parallel to the others.

9. The timepiece according to claim 6, wherein each operating rod comprises raised areas, with a same curvilinear spacing as said control lifts, which said operating rods are arranged to cooperate with, said raised areas being arranged to each cooperate with a peripheral contour of a corresponding control lift to cause said control lift to change position during their relative movement by pivoting and/or translation movement of said control lift and to immobilise said corresponding control lift when it is in said released position.

10. The timepiece according to claim 9, wherein each of said operating rods comprise concentric circular profiles for guidance on runners forming part of a bottom plate or a bridge of said timepiece.

11. The timepiece according to claim 9, wherein each of said operating rods comprise straight parallel profiles for guidance on runners forming part of a bottom plate or a bridge of said timepiece.

12. The timepiece according to claim 1, wherein in the given lift plane, several said control lifts are arranged to actuate hammers located on different hammer planes, on which they are arranged to strike different gongs.

13. The timepiece according to claim 1, wherein in said given lift plane, said tune selection devices are arranged to simultaneously control passage of each control lift forming part of said given lift plane, from said released position to said resting position or vice versa, and in that at each instant when each control lift forming part of said given lift plane is in free state without interaction with said control part controlling said given lift plane, some of said control lifts forming part of said given lift plane are in said released position and the other said control lifts forming part of said given lift plane are in said resting position.

14. The timepiece according to claim 1, wherein each control lift is fitted with elastic restoring elements endeavouring to bring the control lift back to either said released or said resting position.

15. The timepiece according to claim 14, wherein each control lift is fitted with elastic restoring elements endeavouring to bring the control lift back to said resting position.

16. The timepiece according to claim 1, wherein each control lift comprises a beak arranged to cooperate with said control part to drive said control lift during a movement of said control part to rest on said beak.

17. The timepiece according to claim 16, wherein on a periphery and spaced from said beak, each control lift comprises at least one hollow profile delimited by a first wing and by a second wing, wherein said hollow profile is arranged to cooperate with a raised section forming part of an operating rod belonging to said tune selection devices, and said operating rod is arranged to control a change in position of each control lift.

18. The timepiece according to claim 1, wherein each hammer comprises at least one hammer stop arranged to be shifted by at least one of said control lifts.

19. The timepiece according to claim 18, wherein at least one of said hammers comprise several of said hammer stops, which are arranged to be shifted by different control lifts.

20. The timepiece according to claim 18, wherein at least one of said hammers comprise at least one said hammer stop arranged to be shifted by different control lifts located in different lift planes.

21. The timepiece according to claim 1, wherein said manual control actuates said tune selection devices by way of guide devices, which comprise at least as many guide stages as said tune selection devices have selection stages, wherein each selection stage comprises an operating rod arranged to modify a position of at least one said control lift.

22. The timepiece according to claim 21, wherein said manual control comprises a control lift controlling movement of a hook to pull a ratchet toothing of a multi-stage column wheel forming part of said guide devices, wherein on its a periphery on each guide stage, said multi-stage column wheel comprises an alternation of solid and hollow profiles, towards which a finger of a selection lever is restored by elastic restoring devices, which drives by way of an articulated joint at least one said operating rod from a corresponding selection stage to a guide stage.

23. The timepiece according to claim 1, wherein said tune selection devices comprise at least two selection stages, each comprising an operating rod arranged to modify a position of at least one control lift, wherein said operating rod comprises a particular cam profile for performing, in combination with the control part controlling said control lifts of said control level cooperating with said operating rod, at least one particular tune sequence, when at least one said control lift is in the resting position, or to remain in a silent mode if all the control lifts of said control level are each in the released position.

24. The timepiece according to claim 1, wherein said timepiece is a musical box.

25. The timepiece according to claim 1, wherein said timepiece is a watch.

* * * * *